US008333455B2

(12) United States Patent
Ogura

(10) Patent No.: US 8,333,455 B2
(45) Date of Patent: Dec. 18, 2012

(54) IMAGE FORMING APPARATUS

(75) Inventor: Yoshimitsu Ogura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 190 days.

(21) Appl. No.: 12/805,499

(22) Filed: Aug. 3, 2010

(65) Prior Publication Data

US 2011/0090269 A1 Apr. 21, 2011

(30) Foreign Application Priority Data

Aug. 10, 2009 (JP) ..... 2009-186157

(51) Int. Cl.
*B41J 23/00* (2006.01)

(52) U.S. Cl. ..... 347/37

(58) Field of Classification Search ..... 347/9–11, 347/37, 68, 104
See application file for complete search history.

(56) References Cited

U.S. PATENT DOCUMENTS

| | | | | |
|---|---|---|---|---|
| 6,471,319 | B1 * | 10/2002 | Adkins et al. | 347/11 |
| 7,527,371 | B2 * | 5/2009 | Yanagi et al. | 347/104 |
| 7,753,465 | B2 * | 7/2010 | Griesemer et al. | 347/14 |
| 2008/0225070 | A1 | 9/2008 | Morishita et al. | |
| 2009/0028586 | A1 | 1/2009 | Yamashiro et al. | |
| 2009/0237744 | A1 | 9/2009 | Ogura et al. | |
| 2010/0196025 | A1 | 8/2010 | Ogura | |

FOREIGN PATENT DOCUMENTS

| | | |
|---|---|---|
| JP | 03-256772 | 11/1991 |
| JP | 2001-138499 | 5/2001 |
| JP | 2003-237165 | 8/2003 |
| JP | 2005-081673 | 3/2005 |
| JP | 2005-212160 | 8/2005 |
| JP | 4390508 | 10/2009 |

OTHER PUBLICATIONS

Abstract of JP 2005-081673 published on Mar. 31, 2005.

* cited by examiner

*Primary Examiner* — An Do
(74) *Attorney, Agent, or Firm* — Harness, Dickey & Pierce, P.L.C.

(57) ABSTRACT

A vibration damping member, for dampening vibration triggered by movement of a carriage, is driven to move by a vibration-damping drive motor that is a different drive source from a drive source of the carriage. The vibration-damping drive motor includes a stepping motor which may be controlled by an input of a pulse. A carriage-position detecting unit for detecting the position of the carriage in a moving direction updates the position count each time the carriage is moved by a predetermined amount. Each time the position count of the carriage-position detecting unit is updated by a predetermined amount, a first pulse generating unit generates a pulse that causes the vibration-damping drive motor to move by one step. The vibration-damping drive motor is driven with the pulse, thereby causing the vibration damping member to move.

8 Claims, 11 Drawing Sheets

| | POSITION COUNT INCREMENT | | | | POSITION COUNT DECREMENT | | | |
|---|---|---|---|---|---|---|---|---|
| ENCODER A-PHASE | LOW | ↑ | HIGH | ↓ | ↓ | LOW | ↑ | HIGH |
| ENCODER B-PHASE | ↑ | HIGH | ↓ | LOW | HIGH | ↓ | LOW | ↑ |

| | STEP ① | STEP ② | STEP ③ | STEP ④ |
|---|---|---|---|---|
| STEPPING MOTOR A-PHASE | HIGH | LOW | LOW | HIGH |
| STEPPING MOTOR B-PHASE | HIGH | HIGH | LOW | LOW |
| STEPPING MOTOR /A-PHASE | LOW | HIGH | HIGH | LOW |
| STEPPING MOTOR /B-PHASE | LOW | LOW | HIGH | HIGH |

IMAGE FORMING APPARATUS

CROSS-REFERENCE TO RELATED APPLICATIONS

The present application claims priority to and incorporates by reference the entire contents of Japanese Patent Application No. 2009-186157 filed in Japan on Aug. 10, 2009.

BACKGROUND OF THE INVENTION

1. Field of the Invention

The present invention relates to an image forming apparatus, and more particularly, to an image forming apparatus in which an image forming unit is mounted on a carriage to reciprocate the image forming unit.

2. Description of the Related Art

As an image forming apparatus for such devices as a printer, a facsimile machine, a copier, a plotter, and a multifunction peripheral (MFP) of such devices, as an image forming apparatus, an ink-jet recording apparatus or the like is known as a liquid discharge recording type image forming apparatus using, for example, a recording head for discharging ink droplets. This liquid discharge recording type image forming apparatus forms (records, prints out, or reproduces are used as synonyms) an image by discharging ink droplets from the recording head onto a sheet being conveyed (a sheet is not limited to a paper sheet, but includes an OHP sheet and the like; a sheet means something to which ink droplets or other liquids adhere; a sheet is also referred to as a medium to be recorded, a recording medium, recording paper, a recording sheet, etc.), and includes a serial-type image forming apparatus and a line-type image forming apparatus using a line-type head. The serial-type image forming apparatus forms an image by discharging droplets from the recording head while moving the recording head in a main scanning direction. The line-type image forming apparatus forms an image by discharging droplets from the recording head in a state where the recording head is not moved.

Incidentally, in the present application, a liquid discharge recording type "image forming apparatus" means an apparatus that forms an image by discharging a liquid onto a medium, such as paper, yarn, fiber, fabric, leather, metal, plastic, glass, wood, and ceramic. Furthermore, to "form an image" means not only to provide an image having a meaning, such as a text and a drawing, on the medium but also to provide an image having no meaning, such as a pattern, on the medium (just make droplets land on the medium). Moreover, "ink" is not limited to a material referred to as ink, but includes anything that can be turned into a liquid when discharged, such as a DNA sample, resist, and a pattern material. Furthermore, an "image" is not limited to a planar image, but includes an image formed on a sterically-formed medium and an image formed by three-dimensionally modeling a solid body.

As such an image forming apparatus, as described above, there is known a serial-type image forming apparatus in which a recording head including a liquid discharge head, which is an image forming unit, is mounted on a carriage. The serial-type image forming apparatus forms an image by discharging droplets from the recording head while moving the liquid discharge head in a main scanning direction and intermittently moving a medium in a sub-scanning direction perpendicular to the main scanning direction. Incidentally, in the following, an example where the image forming unit is a liquid discharge head is described; however, the image forming unit is not limited to the liquid discharge head, and the present invention may be equally applied to other image forming units.

In such a serial-type image forming apparatus, the reciprocating movement of the carriage mounting thereon the recording head triggers vibration of the main body of the apparatus. Especially, with an increase in the moving speed of the carriage to achieve an increase in the speed of a print job, the acceleration and deceleration of the carriage during the main scanning become more rapid, and thus the vibration of the main body of the apparatus becomes larger. Furthermore, in an MFP equipped with an image reading device (a scanner), due to the vibration of the main body of the apparatus occurring at the side of the image forming unit, the scanner when reading an image is vibrated, which causes a degradation of the read image.

Therefore, conventionally, vibration of the carriages is dampened. For example, as disclosed in Japanese Patent Application Laid-open No. 2001-138499 and Japanese Patent Application Laid-open No. 2005-081673, it is known that a vibration damping member having about the same mass as a carriage is attached to a timing belt for moving the carriage. The vibration of the carriage is dampened by moving the carriage and the vibration damping member in opposite directions to each other.

Furthermore, an apparatus is disclosed in Japanese Patent Application Laid-open No. H3-256772. The apparatus includes a weight having about the same mass as a printer head and a scanning mechanism for moving the weight in the opposite direction to the moving direction of the printer head at the same acceleration as the printer head. This scanning mechanism for moving the weight is separate from the scanning mechanism for moving the carriage.

Moreover, as disclosed in Japanese Patent Application Laid-open No. 2005-212160, it is known that impact force applied on a main body of a printer is detected and a supporting power of a printer supporting unit is controlled in accordance with the detected impact force. In addition, an apparatus is disclosed in Japanese Patent Application Laid-open No. 2003-237165, which includes a vibration damping unit for dampening the vibration of a transmitting member for transmitting a driving force to a carriage.

However, as in the conventional technologies such as Japanese Patent Application Laid-open No. 2001-138499 and Japanese Patent Application Laid-open No. 2005-081673, if a vibration damping member (also referred to as a "counter weight") is attached to a timing belt for moving a carriage, the counter weight also moves (for dampening vibration of the carriage) every time the carriage moves; therefore, if there is a minute variation in the moving speed of the carriage, if there is a variation in the moving load on the carriage, or if there is a variation in the weight of the carriage due to a change in the remaining amount of ink if an apparatus includes an ink tank, and the like, the damping action of the vibration damping member produces vibration of the carriage rather than counteracts the vibration of the carriage. This means that, for example, when a liquid discharge head is used, the accuracy of the droplet landing position is decreased, and thus the image quality may be degraded.

In addition, there are problems in that the load on a drive source of a main scanning mechanism for moving the carriage increases, and in that the weight and size of the entire apparatus increase because of the use of the vibration damping member having about the same mass as the carriage.

Consequently, as disclosed in Japanese Patent Application Laid-open No. H3-256772, by employing a separate drive source for moving the vibration damping member from the drive source for moving the carriage, the problems associated with the vibration damping mechanism using the same drive source as the carriage may be resolved.

However, in such a configuration, the carriage and the vibration damping member, which are driven by the different drive sources, have to be moved in the opposite directions by the same forces and at the same timings; therefore, there arises a problem that a configuration for controlling the forces and timings to be synchronized with each other has to be designed without complicating the configuration and applying high load to a control device.

SUMMARY OF THE INVENTION

It is an object of the present invention to at least partially solve the problems in the conventional technology. According to an aspect of the present invention, an image forming apparatus includes: a carriage that mounts thereon an image forming unit and reciprocates in a main scanning direction; a carriage-position detecting unit that detects a position of the carriage in a moving direction; a vibration damping unit that includes a vibration damping member driven to move by a vibration-damping drive source which may be controlled by an input of a pulse, and dampens vibration triggered by a movement of the carriage, the vibration-damping drive source being a different drive source from a drive source of the carriage; a first pulse generating unit that generates the pulse to be given to the vibration-damping drive source in synchronization with the position of the carriage obtained by the carriage-position detecting unit; and a vibration-damping control unit that gives the pulse from the first pulse generating unit to the vibration-damping drive source thereby causing the vibration damping member to move.

According to another aspect of the present invention, an image forming method that uses the image forming apparatus according present invention includes: reciprocating the carriage in a main scanning direction; detecting a position of the carriage in a moving direction; dampening vibration triggered by the movement of the carriage; generating the pulse to be given to the vibration-damping drive source in synchronization with the position of the carriage obtained by the carriage-position detecting unit; and giving the pulse from the first pulse generating unit to the vibration-damping drive source thereby causing the vibration damping member to move.

According to still another aspect of the present invention, a computer program product that is used in the image forming apparatus according to the present invention includes the computer program product that includes a computer usable medium having computer readable program codes embodied in the medium that when executed causes a computer to execute: reciprocating the carriage in a main scanning direction; detecting a position of the carriage in a moving direction; dampening vibration triggered by the movement of the carriage; generating the pulse to be given to the vibration-damping drive source in synchronization with the position of the carriage obtained by the carriage-position detecting unit; and giving the pulse from the first pulse generating unit to the vibration-damping drive source thereby causing the vibration damping member to move.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
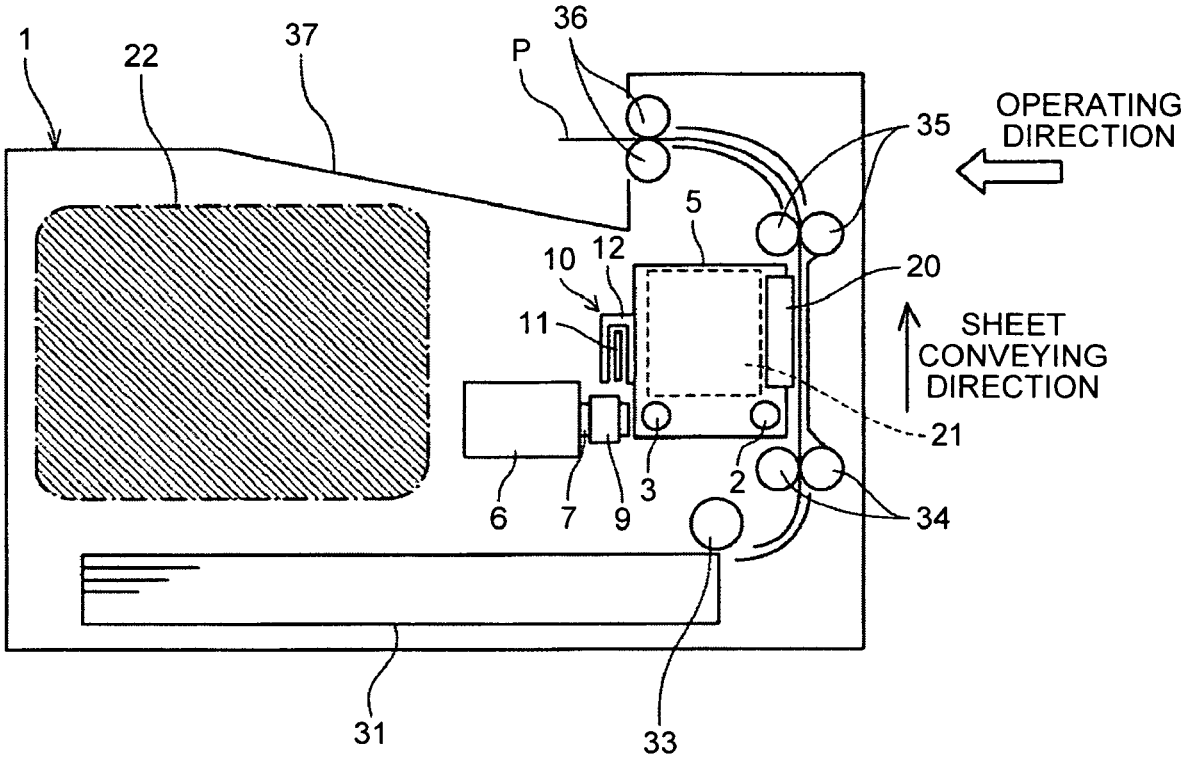
FIG. 1 is a schematic configuration diagram illustrating an entire configuration of an example of an image forming apparatus according to the present invention.

Exemplary embodiments of the present invention are explained below with reference to the accompanying drawings. First, an example of an image forming apparatus to which the present invention is applied is explained with reference to FIG. 1. FIG. 1 is a schematic configuration diagram illustrating an entire configuration of the image forming apparatus.

According to the image forming apparatus, in an apparatus main body 1, a carriage 5 is slidably held by a guide rod 2 which is a main guide member and a guide rod 3 which is a sub-guide member, so that the carriage 5 may slide in a main scanning direction (in a longitudinal direction of the guide rods, which is a direction perpendicular to the paper plane of FIG. 1).

The carriage 5 is moved in the main scanning direction by a main scanning mechanism that includes a main scanning motor 6 which is a drive source, a drive pulley 7, a driven pulley (not shown), and a timing belt 9. An encoder scale 11 made of resin film or the like is arranged along the main scanning direction of the carriage 5. An encoder sensor 12 that includes a transmissive photosensor for reading the scale (scale: a position identifying unit) of the encoder scale 11 is mounted on the back side of the carriage 5. The encoder scale 11 and the encoder sensor 12 are included in a linear encoder 10 for detecting the position of the carriage.

The carriage 5 is equipped with a recording head 20 as an image forming unit, and also detachably equipped with an ink cartridge 21 as a liquid cartridge. The recording head 20 includes a liquid discharge head for discharging liquid droplets. The ink cartridge 21 contains ink, a liquid to be supplied to the recording head 20. Alternatively, the carriage 5 may be equipped with a sub-tank (including those referred to as a buffer tank and a head tank) instead of the ink cartridge 21, and the replaceable ink cartridge (a main tank) may be arranged at a different part in the apparatus main body 1.

The recording head 20 is connected to a control board (not shown) which is arranged in an area 22 on the rear side of the apparatus main body 1 by a flexible cable (not shown) led out from the carriage 5. Incidentally, in the area 22, in addition to the control board, a power supply board and the like are arranged. The flexible cable is related to a means for transmitting an image signal from the control board and is a film, having flexibility, on which a wiring pattern is printed. Data is transmitted between the carriage 5 and the control board via the flexible cable. The flexible cable follows the movement of the carriage 5.

A sheet cassette 31, which contains sheets P that are media to be recorded, is removably mounted on the lower side of the apparatus main body 1. A sheet P contained in the sheet cassette 31 is sent out by a sheet feed roller 33, and conveyed in a sheet conveying direction (a sub-scanning direction) in a state where the sheet P is held between pairs of conveyance rollers 34 and 35 so as to be opposed to the recording head 20. Then, with liquid droplets discharged from the recording head 20, an image is formed on the sheet P being conveyed. The sheet P on which the image has been formed is discharged from the apparatus main body 1 by a pair of sheet discharge rollers 36 (composed of a pair of rollers, rollers and spurs, and the like), and stacked onto a discharged-sheet stack unit 37 on top of the apparatus main body 1.

Incidentally, although it is not illustrated in the drawing, a maintaining/recovering mechanism for maintaining and recovering the performance of the recording head 20 is arranged on the one end side in the main scanning direction and the front side of the apparatus main body 1.

This image forming apparatus intermittently conveys a sheet P in the sub-scanning direction while moving the carriage 5 in the main scanning direction, and forms an image on the sheet P by discharging liquid droplets from the recording head 20 in accordance with image data, and then discharges the sheet P on which the image has been formed onto the discharged-sheet stack unit 37.

Incidentally, this image forming apparatus is configured to convey a sheet in a vertical direction (including an obliquely upward direction); alternatively, it may be configured that the recording head 20 is arranged so that a droplet discharging direction of the recording head 20 is directed downward and a sheet is conveyed in a horizontal direction.

Figure 2A:
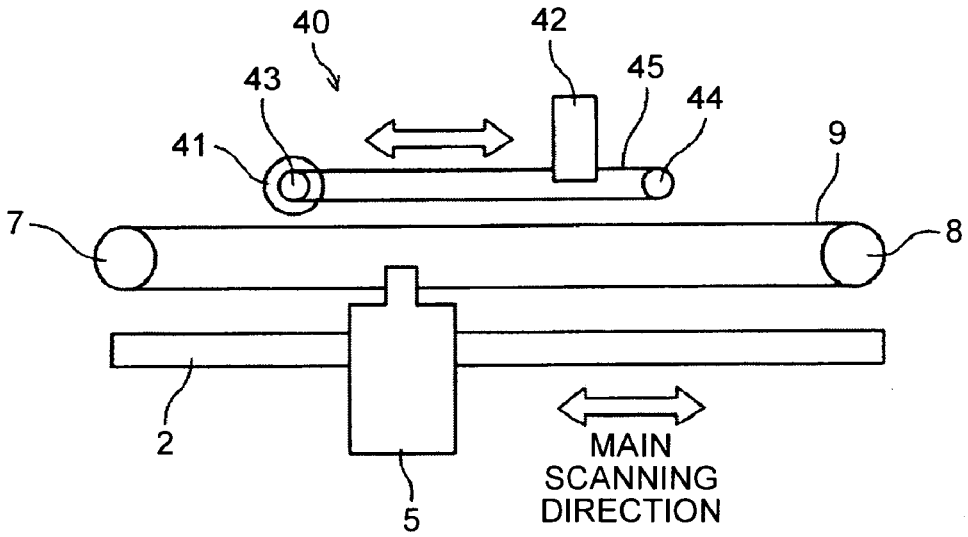
FIGS. 2A and 2B are schematic explanatory diagrams for explaining an example of a vibration damping unit in the apparatus.
Figure 2B:
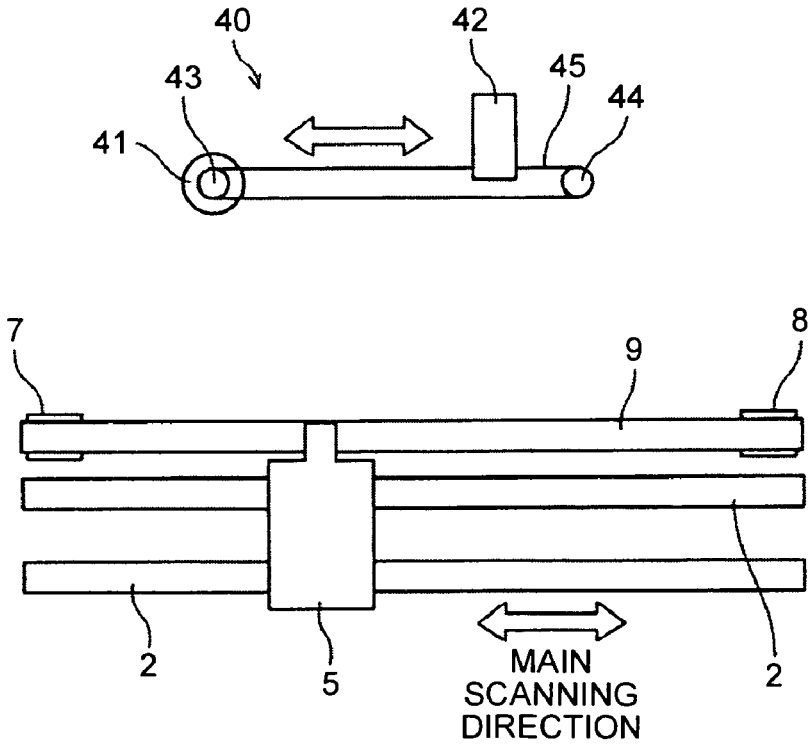

Subsequently, a vibration damping unit in this image forming apparatus is explained with reference to FIGS. 2A and 2B. FIGS. 2A and 2B are explanatory plane views of main parts of the vibration damping unit including examples of different layouts of the vibration damping unit.

A vibration damping mechanism 40, as the vibration damping unit for dampening vibration of the apparatus main body 1 triggered by the movement of the carriage 5, includes: a vibration-damping drive motor 41; a vibration damping member (a counter weight) 42; and a timing belt 45. The vibration-damping drive motor 41 includes a stepping motor which is a separate drive source from the main scanning motor 6, which is a drive source of the carriage 5. The vibration damping member 42 is a mass body having a mass smaller than that of the carriage 5, and is moved in the main scanning direction (a direction of arrows) by the vibration-damping drive motor 41. The vibration damping member 42 is mounted on the timing belt 45. The timing belt 45 is a belt-like member that is movably disposed and looped over a drive pulley 43, which is driven to rotate by the vibration-damping drive motor 41, and a driven pulley 44 so as to move in the main scanning direction.

In the vibration damping mechanism 40, the vibration-damping drive motor 41 is driven, and the timing belt 45 is moved, whereby the vibration damping member 42 is moved in the main scanning direction (the direction of arrows), and when the vibration damping member 42 stops moving by stopping the driving of the motor 41, an inertia force is generated on the vibration damping member 42. By making this inertia force directed to a direction opposite to an inertia force generated by the movement of the carriage 5, vibration of a frame of the apparatus main body 1 triggered by the movement of the carriage 5 may be dampened.

In this image forming apparatus, the components required for image formation are concentrated in the front side (the side of an operation unit) of the apparatus main body 1, and furthermore, the maintaining/recovering mechanism is also arranged on the front side of the apparatus as described above. In contrast to the above described components, the boards and the like arranged in the area 22 are smaller in mass compared to the above described components, so that as illustrated in FIG. 1, the center of gravity of the apparatus is located on the front side, and the mass balance is bad. Furthermore, to enhance jam processing performance, as illustrated in FIGS. 2A and 2B, the paired rollers are arranged to be kept away from each other, so the position of the center of gravity further shifts to the front side, and the mass balance further worsens.

In the area 22 marked with diagonal lines in FIG. 1, as described above, the control board, the power supply board, and the like are arranged; however, the area 22 has a space to spare because the main components are arranged on the front side. By arranging the vibration damping mechanism 40 in this space, the position of the center of gravity may be shifted to the rear side, and the balance of the center of gravity of the apparatus main body may be redressed. The larger distance from the position of the center of gravity of the apparatus main body 1 the vibration damping mechanism 40 keeps, the larger the amount of shift of the center of gravity; therefore, the vibration damping mechanism 40 is preferably arranged on the rear side of the apparatus main body 1 as much as possible. Namely, it is preferable that the vibration damping mechanism 40 is arranged on the rear side of the apparatus main body 1 to be kept away from the carriage 5 as illustrated in FIG. 2B rather than to be close to the carriage 5 as illustrated in FIG. 2A.

Subsequently, a control unit of the image forming apparatus according to a first embodiment of the present invention is explained with reference to an explanatory block diagram illustrated in FIG. 3.

A print control unit 100 receives image data from an external information processing apparatus (not shown), such as a personal computer, an image reading apparatus (not shown), or the like, and instructs any one of a head control unit 101, a conveyance control unit 102, a carriage control unit 103, and a vibration-damping-member control unit 104 to operate in accordance with the received image data.

The head control unit 101 conducts a drive control of the recording head 20 via a head drive unit 105, thereby causing the recording head 20 to discharge liquid droplets to form an image on a sheet P.

The conveyance control unit 102 conducts a drive control of a sub-scanning motor 108 via a conveyance drive unit 107 by calculating an amount of control, for example, by the PI control or the like on the basis of a deviation of a current position with respect to a target position in accordance with a profile (not shown) of a target of speed on the basis of a position obtained by a feed-amount detecting unit. The feed-amount detecting unit includes a rotary encoder for detecting a rotation amount of the sub-scanning motor 108 for driving a conveyance mechanism 109 that includes the pairs of conveyance rollers 34 and 35 described above, etc., thereby causing the sheet P conveyed by a predetermined amount.

The carriage control unit 103 makes the carriage 5 move and scan in the main scanning direction at a predetermined speed by conducting a drive control of the driving motor 6, which is a carriage driving motor, via a carriage drive unit 110 by calculating an amount of control, for example, by the PI control or the like. The amount of control is calculated on the basis of a deviation of a current speed with respect to a target speed in accordance with a profile of a target of speed of the carriage 5 stored in a carriage-speed-profile storage unit 114 and a position and speed obtained by a carriage-position detecting unit 113. The carriage-position detecting unit 113 includes the above-described linear encoder 10 for detecting the position of the carriage 5.

The carriage-position detecting unit 113 includes a position count (counter) for counting the state transitions. of an A-phase signal and a B-phase signal from the linear encoder 10. The carriage-position detecting unit 113 outputs a value of the position count to a first pulse generating unit 118.

Each time the position count of the carriage-position detecting unit 113 is updated, the first pulse generating unit 118 generates and outputs a pulse that moves the vibration-damping drive motor 41, which includes the stepping motor, by one step.

When the vibration-damping-member control unit 104 receives the pulse from the first pulse generating unit 118, the vibration-damping-member control unit 104 conducts a drive control of the vibration-damping drive motor 41, which includes a stepping motor, and moves the vibration damping member 42 via a vibration-damping-member drive unit 115.

At this time, the vibration damping member 42 is controlled to be moved in an opposite direction to a direction of the movement of the carriage 5 by substantially the same force as the carriage 5 at substantially the same timing as the carriage 5.

First, the vibration damping operation of the vibration damping member 42 is explained.

When the carriage 5 is moved in the main scanning direction by: the carriage control unit 103, a reaction force from the carriage 5 to the apparatus main body 1 is generated by acceleration of the carriage 5, which is a cause of vibration of the apparatus main body 1. A reaction force from the vibration damping member 42 against the apparatus main body 1 is also generated as the vibration damping member 42 is moved by the vibration-damping-member control unit 104. However, the reaction force from the vibration damping member 42 is controlled to be about the same as the reaction force from the carriage 5 to the apparatus main body 1 and be exerted on the apparatus main body 1 in an opposite direction to the direction of the reaction force from the carriage 5 to the apparatus main body 1 at about the same timing as the reaction force from the carriage 5 to the apparatus main body 1. Thus the reaction forces are balanced out, and the generation of vibration of the apparatus main body 1 may be suppressed.

Figure 4:
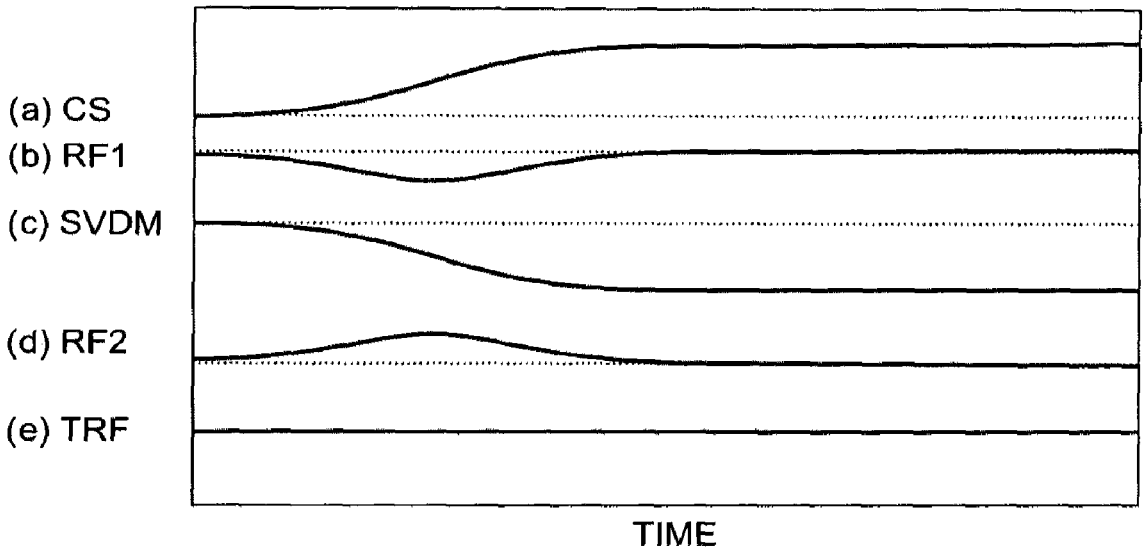
FIG. 4 is an explanatory diagram for explaining a vibration damping effect when a reaction force exerted on a main body of the apparatus by driving a carriage is equal to a reaction force exerted on the main body of the apparatus by driving a vibration damping member.

Namely, for example, as illustrated in FIG. 4(*a*), when the carriage 5 shifts at a carriage speed (CS) from acceleration in a forward direction to movement at a constant speed, a reaction force (RF1) (moving-body weight×acceleration) exerted on the apparatus main body 1 by driving of the carriage 5 changes as illustrated in FIG. 4(*b*). In contrast, as illustrated in FIG. 4(*c*), the vibration damping member 42 is moved at a speed of a vibration damping member (SVDM) in an opposite direction to the moving direction of the carriage 5, and a reaction force (moving-body weight×acceleration) exerted on the apparatus main body 1 by driving of the vibration damping member 42 is controlled to be exerted in an opposite direction to the direction of the reaction force exerted on the apparatus main body 1 by driving of the carriage 5. In addition, the reaction force exerted on the apparatus main body 1 by driving of the vibration damping member 42 is controlled to have the same magnitude as the reaction force (RF2) exerted on the apparatus main body 1 by driving of the carriage 5 as illustrated in FIG. 4(*d*). Thus, as illustrated in FIG. 4(*e*), the respective reaction forces act in the opposite directions and have the same magnitude, and the total reaction force (TRF) becomes zero, and therefore, vibration of the apparatus main body 1 due to the reaction forces is not generated.

However, in the configuration that the carriage 5 and the vibration damping member 42 are driven by separate drive sources (the main scanning motor 6 and the vibration-damping drive motor 41), when the forces or timings for accelerating the carriage 5 and the vibration damping member 42 are out of synchronization, the reaction forces may not be balanced out, and a sufficient vibration damping effect may not be obtained.

Figure 5:
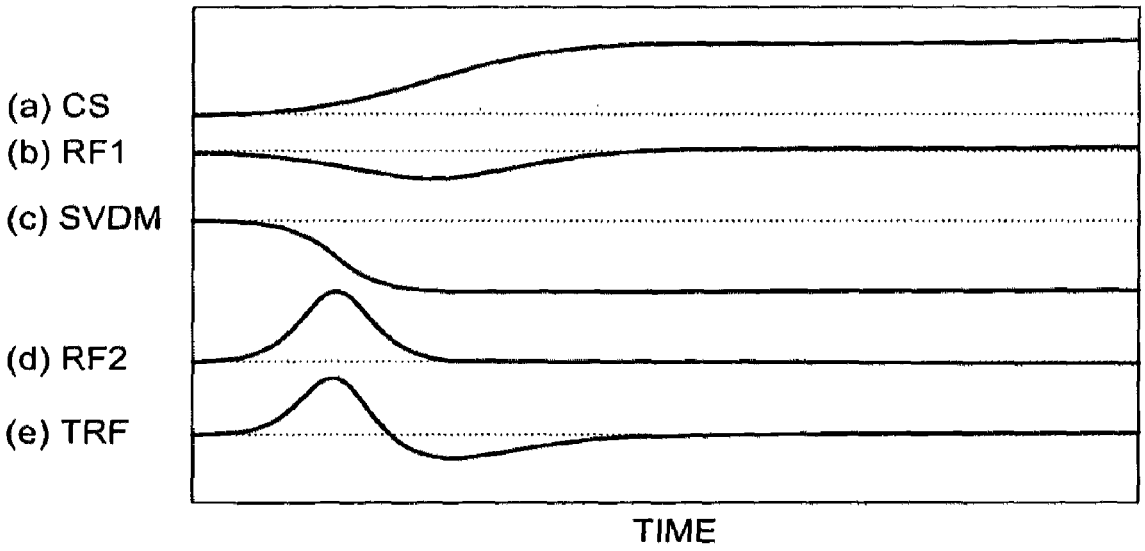
FIG. 5 is an explanatory diagram for explaining a vibration damping effect when a reaction force exerted on the main body of the apparatus by driving the carriage is different from a reaction force exerted on the main body of the apparatus by driving the vibration damping member.

For example, as illustrated in FIG. 5, when an acceleration of the vibration damping member 42 is high, and the vibration damping member 42 finishes acceleration earlier than the carriage 5, the respective reaction forces exerted on the apparatus main body 1 are out of synchronization, and as illustrated in FIG. 5(*e*), the total reaction force (TRF) swings up and down, and a sufficient vibration damping effect may not be obtained.

Thus, in the present invention, to synchronize the magnitude (force) and timing of a reaction force caused by driving of the vibration damping member 42 with those of a reaction force caused by driving of the carriage 5, a pulse for driving the vibration-damping drive motor 41 to move the vibration damping member 42 in synchronization with the carriage position obtained by the carriage-position detecting unit 113 is generated, and the vibration damping member 42 is moved in synchronization with the movement of the carriage 5.

By this configuration, the vibration-damping-member control unit 104 may not need to monitor the drive timing of the carriage 5 to synchronize the drive timings of the carriage 5 and the vibration damping member 42, and also may not need to consciously control so that the carriage 5 and the vibration damping member 42 both move at the determined acceleration (acceleration profile), so the control may be simplified. Abbreviations in FIG. 5 identical to those in FIG. 4 are denoted with like reference legends and descriptions thereof will be omitted.

A case where the carriage position is detected by the linear encoder 10 and the vibration damping member 42 is driven to move by driving the stepping motor as the vibration-damping drive motor 41 by two-phase excitation is explained with reference to FIGS. 6 to 8.

Figures 6, 7, 8:
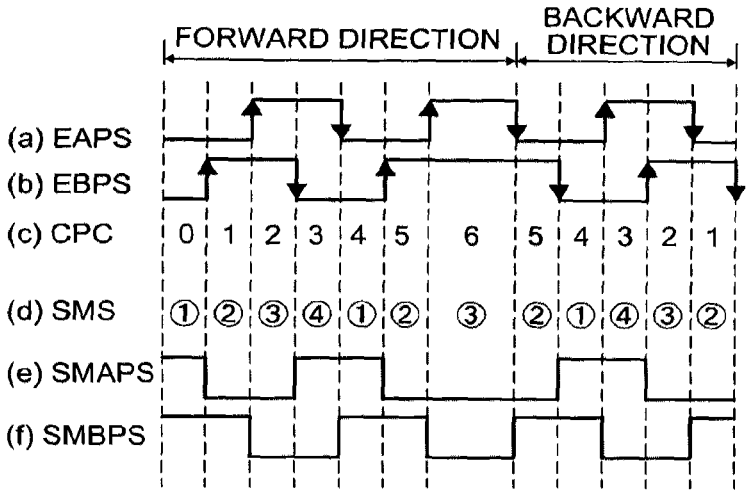
FIG. 6 is an explanatory diagram illustrating an example of an encoder output and a position count of a carriage-position detecting unit and steps and A-phase and B-phase signals, which are abbreviated as EAPS and EBPS respectively, of a stepping motor in the first embodiment.
FIG. 7 is an explanatory diagram for explaining update of the position count of the carriage-position detecting unit.
FIG. 8 is an explanatory diagram for explaining two-phase excitation of the stepping motor.

As illustrated in FIG. 6(*a*)(*b*), detected two phases of signals (an A-phase signal and a B-phase signal which are respectively abbreviated as EAPS and EBPS) of which the phases are shifted by 90 degrees with respect to the periods of the scale marked on the encoder scale 11 at predetermined intervals are output from the linear encoder 10. From a relationship between the encoder A-phase signal and encoder B-phase signal, the carriage-position detecting unit 113 increments or decrements a count value of the internal position counter (the carriage position count abbreviated as CPC) as illustrated in FIG. 6(*c*) in accordance with the state transitions of the A-phase and B-phase signals as illustrated in FIG. 7.

The stepping motor that is included in the vibration-damping drive motor 41 is a motor that rotates by a predetermined angle (amount of movement) every step of input pulse. The two-phase excitation is one of methods for driving a general stepping motor; as illustrated in FIG. 8, with four steps as one cycle, in each of steps 1 to 4 (indicated by encircled numbers in FIG. 8), pulses are given to an A-phase, a B-phase, a /A-phase, and a /B-phase, thereby driving the stepping motor to rotate in a predetermined direction. Incidentally, in FIG. 8, the "/A-phase" is a phase that the A-phase is inverted, the "/B-phase" is a phase that the B-phase is inverted, and pulses to be generated are for two phases: the A-phase and the B-phase.

In accordance with signals inputted from the linear encoder 10, the carriage-position detecting unit 113 calculates the carriage position count as illustrated in FIG. 6(*c*) in accordance with FIG. 7. The first pulse generating unit 118 progresses or regresses the step illustrated in FIG. 8 in accordance with the increment or decrement of the carriage position count by "one" (an amount of update is set to "one"), and as illustrated in FIG. 6 (*e*) (*f*), generates stepping motor A-phase and B-phase signals (pulses) corresponding to the stepping motor steps (SMS) as illustrated in FIG. 6 (*d*), and outputs the generated stepping motor A-phase and B-phase signals, which are SMAPS and SMBPS. Thus, each time the position of the carriage 5 changes by a predetermined amount, pulses that cause the vibration-damping drive motor 41, a vibration-damping drive source, to move by a predetermined amount is generated. By the stepping motor A-phase signal and the stepping motor B-phase signal, the vibration-damping-member control unit 104 causes the vibration-damping drive motor 41 to be driven via the vibration-damping-member drive unit 115, thereby causing the vibration damping member 42 to move.

Figure 9:
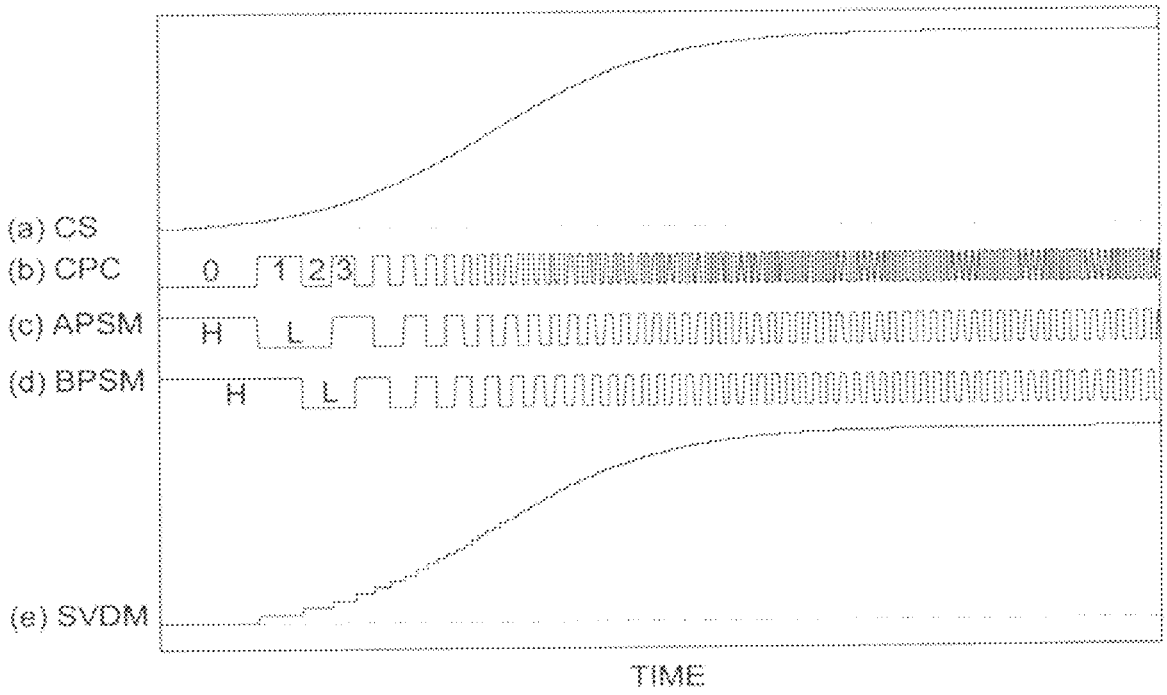
FIG. 9 is an explanatory diagram illustrating an example of speed of the carriage(CS), a carriage position count (CPC), an A-phase and a B-phase of the stepping motor which are respectively abbreviated as APSM and BPSM, and speed of the vibration damping member (SVDM) when the stepping motor is rotated forward by one step each time the carriage position count is incremented by "one"

In this manner, for example, in the configuration that the stepping motor is driven by two-phase excitation in synchronization with driving of the carriage, when the stepping motor is set to be rotated forward by "one" step each time the carriage position count is incremented by "one", the speed of the carriage, the position count, the stepping motor A-phase, the stepping motor B-phase, and the speed of the vibration damping member change as illustrated in FIG. 9.

Incidentally, in the case of the relationship as illustrated in FIG. 6, not in the way as described above, a signal that the encoder A-phase signal is inverted may be used as the stepping motor B-phase signal, and a signal that the encoder B-phase signal is inverted may be used as the stepping motor A-phase signal.

In this manner, it is configured that the vibration-damping drive source is controlled to be driven on the basis of a result of detection by the carriage-position detecting unit thereby causing the vibration damping member to move. Here, it is configured to include the first pulse generating unit that generates pulses to be given to the vibration-damping drive source in synchronization with the carriage position obtained by the carriage-position detecting unit and the vibration-damping-member control unit that gives the pulses from the first pulse generating unit to the vibration-damping drive source thereby causing the vibration damping member to move. In such a simple configuration, the vibration damping member may be moved in synchronization with the movement of the carriage, and the drive source of the vibration damping member, which is a different drive source from that of the carriage, may be controlled to be driven by neither complicating the control nor increasing the load.

Figure 10:
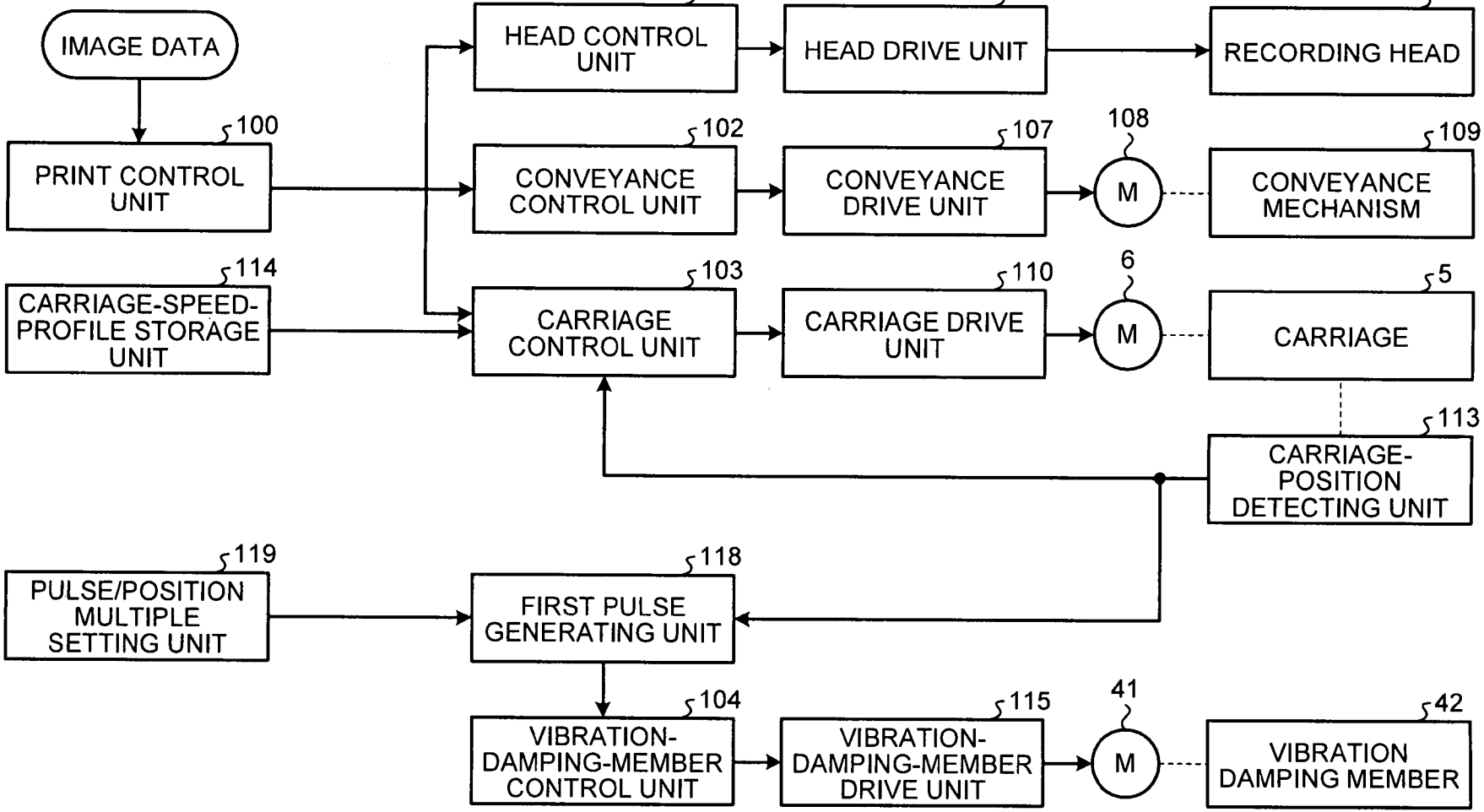
FIG. 10 is an explanatory block diagram for explaining a control unit of the image forming apparatus according to a second embodiment of the present invention.

A control unit of the image forming apparatus according to a second embodiment of the present invention will be explained next with reference to an explanatory block diagram of FIG. 10.

Figure 3:
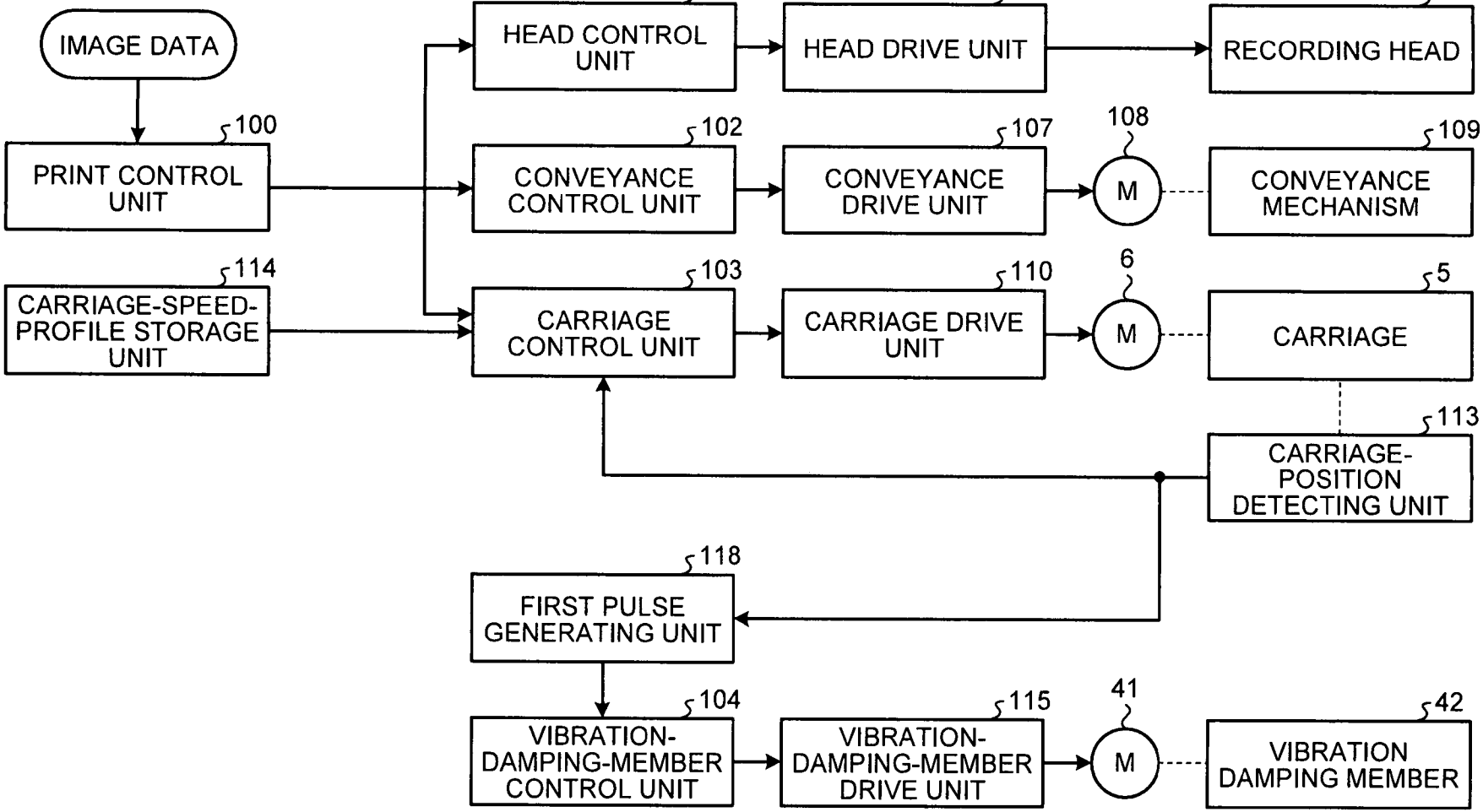
FIG. 3 is an explanatory block diagram for explaining a control unit of the image forming apparatus according to a first embodiment of the present invention.

In the configuration according to the first embodiment described above, when a pulse for driving the vibration damping member 42 in synchronization with the position obtained by a signal from the carriage-position detecting unit 113 is generated, each time the position count is incremented (or decremented) by one, the vibration-damping drive motor 41 of FIG. 3 is configured to be rotated forward (or backward) by one step.

On the other hand, in this second embodiment, the image forming apparatus further includes a pulse/position multiple setting unit 119; when the first pulse generating unit 118 generates a pulse, with a "pulse/position multiple" set by the pulse/position multiple setting unit 119 as "n", each time the position count is incremented (or decremented) by n, the vibration-damping drive motor 41 is configured to be rotated forward (or backward) by one step. Namely, when the first pulse generating unit 118 generates a pulse that causes the vibration-damping drive motor 41 to move by one step, the pulse/position multiple setting unit 119 sets an update amount of the position count value of the carriage-position detecting unit 113 as a pulse/position multiple.

The pulse/position multiple setting unit 119 receives an input from another internal control unit, such as the print control unit 100, or an input by the operation from the outside, such as a DIP switch, and sets a pulse/position multiple. The first pulse generating unit 118 receives the pulse/position multiple from the pulse/position multiple setting unit 119, determines a value n in accordance with the pulse/position multiple, progresses (or regresses) the step in FIG. 8 in accordance with the increment (or decrement) of the carriage position count by n, and outputs stepping motor A-phase and B-phase signals corresponding to the steps.

Figure 11:
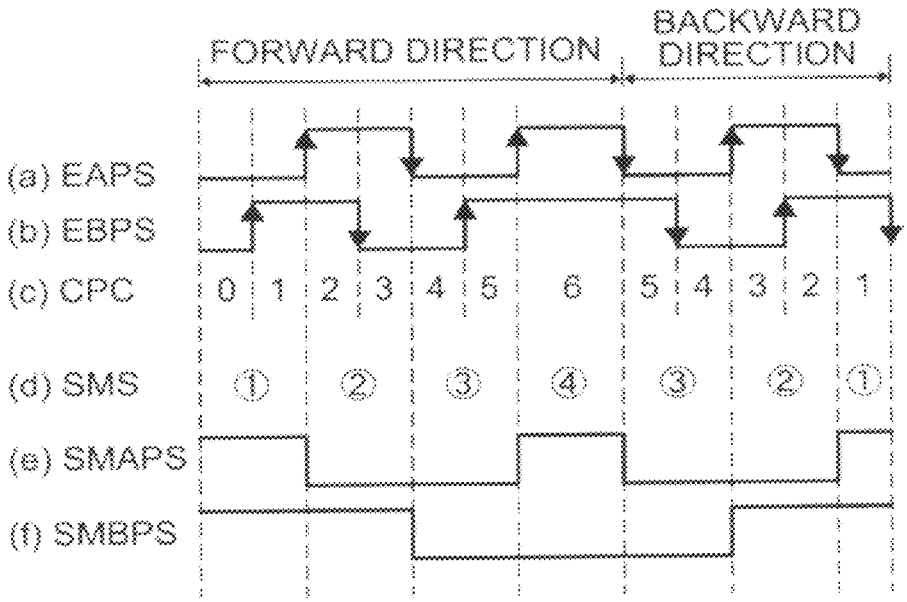
FIG. 11 is an explanatory diagram illustrating an example of an encoder output and a position count of the carriage-position detecting unit and steps and A-phase and B-phase signals of a stepping motor in the second embodiment.

Consequently, for example, as illustrated in FIG. 11, each time the carriage position count (CPC) illustrated in FIG. 11(*c*) is incremented by "2", the stepping motor (the vibration-damping drive motor 41) may be rotated forward by "one" step as illustrated in FIG. 11(*d*) as stepping motor step (SMS). Abbreviations in FIG. 11 identical to those in FIG. 6 are denoted with like reference legends and descriptions thereof will be omitted.

Figure 12:
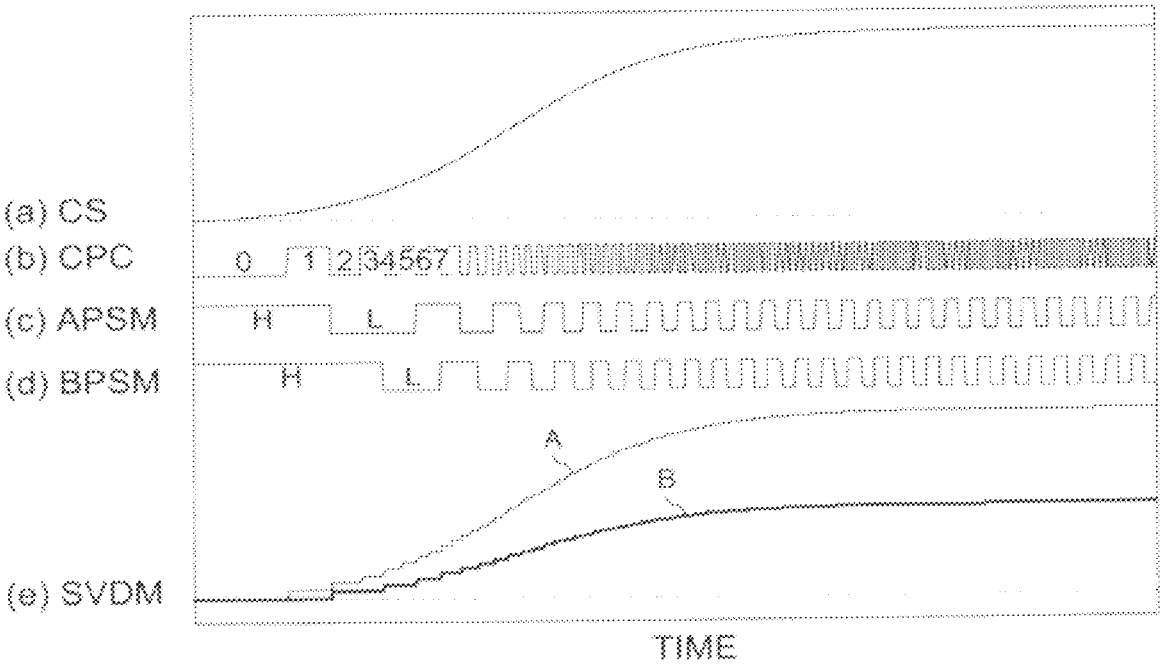
FIG. 12 is an explanatory diagram illustrating an example of the speed of the carriage, the position count, the A-phase and the B-phase of the stepping motor, and the speed of the vibration damping member when the stepping motor is rotated forward by one step each time the carriage position count is incremented by "two" in the configuration that the stepping motor is driven by two-phase excitation in synchronization with driving of the carriage.

In this manner, for example, in the configuration that the stepping motor is driven by two-phase excitation in synchronization with driving of the carriage, when the stepping motor is set to be rotated forward by one step each time the carriage position count is incremented by "two", the speed of the carriage, the position count, the stepping motor A-phase, the stepping motor B-phase, and the speed of the vibration damping member change as illustrated in FIG. 12.

In FIG. 12, "A" indicates a change in the speed of the vibration damping member (SVDM) when the stepping motor is configured to be rotated forward by one step each time the position count is incremented by "one" (the case of FIG. 9), and "B" indicates a change in the speed of the vibration damping member (SVDM) when the stepping motor is configured to be rotated forward by one step each time the position count is incremented by "two". At this time, the acceleration and speed of the vibration damping member in the case of "B" are half those of the vibration damping member in the case of "A" as illustrated in the drawing, and also a moving distance of the vibration damping member in the case of "B" is half that of the vibration damping member in the case of "A".

Incidentally, "B" in speed of vibration damping member in FIG. 12 does not indicate that the speed of the vibration damping member is half the speed of the carriage. Since a relationship between the number of revolutions of the stepping motor and the speed of the vibration damping member depends on a mechanical configuration, such as a motor pulley diameter or a gear ratio, it may be configured that the speed of the carriage and the speed of the vibration damping member coincide with each other in the case of speed of vibration damping member "B" illustrated in FIG. 12. Abbreviations in FIG. 12 identical to those in FIG. 9 are denoted with like reference legends and descriptions thereof will be omitted.

By such a configuration, the acceleration, the speed, and a moving range of the vibration damping member may be dynamically changed depending on a print status.

For example, a pulse/position multiple is set based on a remaining amount of ink of the ink cartridge 21 mounted on the carriage 5. Namely, a reaction force generated by the movement of a moving body is obtained by multiplying the weight of the moving body by the acceleration. In a liquid discharge type image forming apparatus, a remaining amount of ink in a liquid container mounted on a carriage is also included in the weight of the carriage, so if a remaining amount of the ink changes, a reaction force generated by driving of the carriage also changes. Therefore, when the weight of the carriage is decreased by a decrease in remaining amount of the ink with use of the ink, the acceleration for driving the vibration damping member is reduced by the same rate as the decrease in weight of the carriage, as a result, respective reaction forces caused by driving of the carriage and the vibration damping member coincide with each other, and the vibration damping effect is enhanced.

For example, let us assume that the weight of the ink cartridge 21 mounted on the carriage 5 just before the ink cartridge 21 becomes empty is 80% of the weight of the ink cartridge 21 when the ink cartridge 21 is filled up with the ink. The first pulse generating unit 118 sets a "pulse/position multiple" to "10" when the ink cartridge 21 is filled up with ink, "9" when a remaining amount of ink in the ink cartridge 21 is halved, and "8" just before the ink cartridge 21 becomes empty. Thus a value of "weight×acceleration" of the cartridge and a value of "weight×acceleration" of the vibration damping member come closer, and thus the vibration damping effect is enhanced.

Furthermore, when the image forming apparatus has a plurality of print modes with different moving speeds of the cartridge, a pulse/position multiple is set in accordance with the print modes. Namely, when the stepping motor is driven to rotate by drive pulses with a cycle higher than the allowable number of revolutions, the actual rotation of the motor cannot follow the drive pulses, and a phenomenon referred to as a "step-out" occurs. If a motor capable of being driven at a high rotating speed with sufficient torque is provided to avoid the step-out, the cost increases. Moreover, generally, in a print mode for outputting a high-quality image (a high image quality mode), an image is printed by moving the carriage slowly; in a print mode in which the print speed is prioritized over the high image quality (a speed priority mode), an image is printed by moving the carriage faster than it is in the high image quality mode.

The vibration damping member is not always driven so that a reaction force caused by driving the vibration damping member coincides with a reaction force caused by driving the carriage. Instead, by reducing a "pulse/position multiple" only in the speed priority mode, although the vibration damping effect in the speed priority mode is reduced, the maximum number of revolutions of the stepping motor, which is a drive source of the vibration damping member, may be reduced, thus the cost of the stepping motor may be curbed.

To perform a control as described above, for example, the print control unit 100 or the like has a table storing therein pulse/position multiples to be set in accordance with the print modes or a calculating unit for calculating the pulse/position multiples, and determines a pulse/position multiple in accordance with the image data. Then, the determined pulse/position multiple is output to the first pulse generating unit 118 via the pulse/position multiple setting unit 119, and the first pulse generating unit 118 generates a stepping-motor drive signal based on the determined pulse/position multiple, and outputs the generated stepping-motor drive signal.

Figure 13:
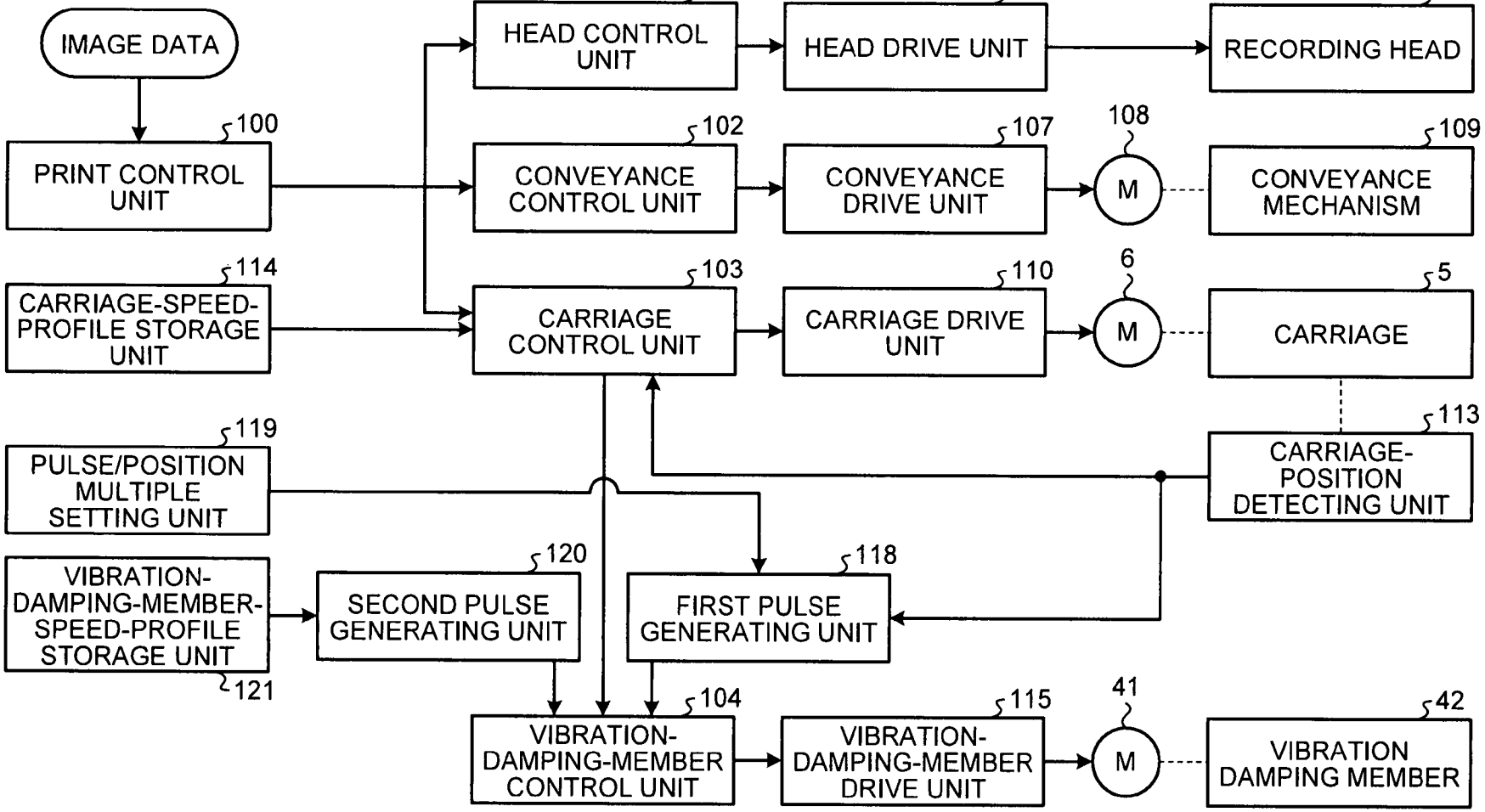
FIG. 13 is an explanatory block diagram for explaining a control unit of the image forming apparatus according to a third embodiment of the present invention.

A control unit of the image forming apparatus according to a third embodiment of the present invention will be explained next with reference to an explanatory block diagram of FIG. 13.

In the third embodiment, the image forming apparatus further includes: a vibration-damping-member-speed-profile storage unit 121 storing therein a profile of the speed of the vibration damping member; and a second pulse generating unit 120 for generating a pulse for driving the vibration-damping drive motor 41 in accordance with the profile of the speed of the vibration damping member stored in the vibration-damping-member-speed-profile storage unit 121. The vibration-damping-member control unit 104 selects one of a pulse generated by the first pulse generating unit 118 and a pulse generated by the second pulse generating unit 120 in accordance with a signal that comes from the carriage control unit 103, and drives the vibration-damping drive motor 41 with the selected pulse.

With such a configuration, only the vibration damping member 42 may be moved without moving the carriage 5 as needed.

For example, when the home positions of the carriage 5 and the vibration damping member 42 are reset, the vibration-damping-member control unit 104 selects the pulse that comes from the second pulse generating unit 120, and controls to drive the vibration-damping drive motor 41 with the selected pulse.

Figure 14A:
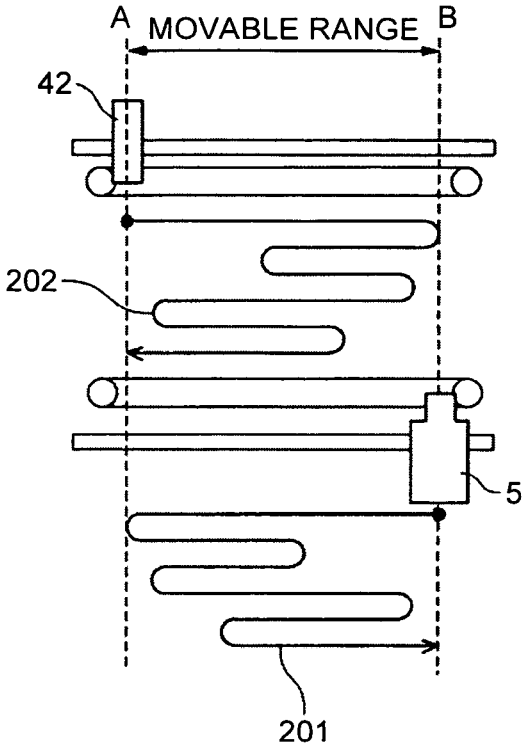
FIGS. 14A and 14B are explanatory diagrams for explaining how to reset a home position of the vibration damping member.

For example, as illustrated in FIG. 14A, assuming that movable ranges of the carriage 5 and the vibration damping member 42 are a range between main-scanning-direction positions A and B, when the carriage 5 and the vibration damping member 42 are moved in opposite directions in synchronization with each other, if a movement trajectory of the carriage 5 is a trajectory 201, a movement trajectory of the vibration damping member 42 is a trajectory 202. If the vibration damping member 42 is in the main-scanning-direction position A when the carriage 5 is in the main-scanning-direction position B, as long as the carriage 5 moves within the movable range, the vibration damping member 42 never gets out of the movable range.

Figure 14B:
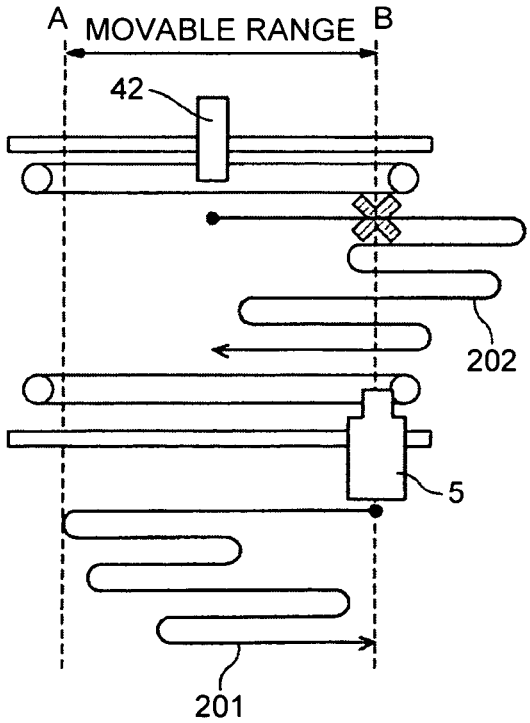

However, as illustrated in FIG. 14B, when the carriage 5 is in the main-scanning-direction position B, if the vibration damping member 42 is positioned on an inner side than the main-scanning-direction position A, even though the carriage 5 moves within the movable range, the vibration damping member 42 may get out of the movable range, and, for example, may bump into a side plate (not shown) (indicated by an "x" mark in the drawing).

Consequently, if there is a possibility that the positional relationship between the carriage 5 and the vibration damping member 42 is not in order, the home position needs to be reset so that the home positions of the carriage 5 and the vibration damping member 42 are in the positional relationship as illustrated in FIG. 14A.

At this time, if the vibration damping member 42 is just driven in synchronization with a change in the position of the carriage by the first pulse generating unit 118, the vibration damping member 42 stops moving if the carriage 5 stops moving, so the home position may not be reset.

On the other hand, the second pulse generating unit 120 generates and outputs a pulse regardless of the movement of the carriage 5, so by controlling to drive the vibration-damping drive motor 41 by selecting a pulse that comes from the second pulse generating unit 120, the home position of the vibration damping member 42 may be reset.

Incidentally, when there is a possibility that the positional relationship between the carriage and the vibration damping member is not in order may be such conditions as the apparatus is being booted up, the encoder sensor which is a detecting unit of the carriage-position detecting unit 113 fails to detect normally, and the carriage 5 bumps into something and is put into abnormal stop by the fail-safe function, etc.; in such conditions as described above, the home position is reset by controlling to drive the vibration-damping drive motor 41 by selecting a pulse that comes from the second pulse generating unit 120.

Furthermore, when the vibration-damping-member control unit 104 dynamically changes a ratio of any one of the acceleration, the speed, and the moving range of the vibration damping member 42 with respect to driving of the carriage 5, i.e., when a pulse/position multiple is changed by the pulse/position multiple setting unit 119, it is controlled to drive the vibration-damping drive motor 41 by selecting a pulse that comes from the second pulse generating unit 120.

Figure 15A:
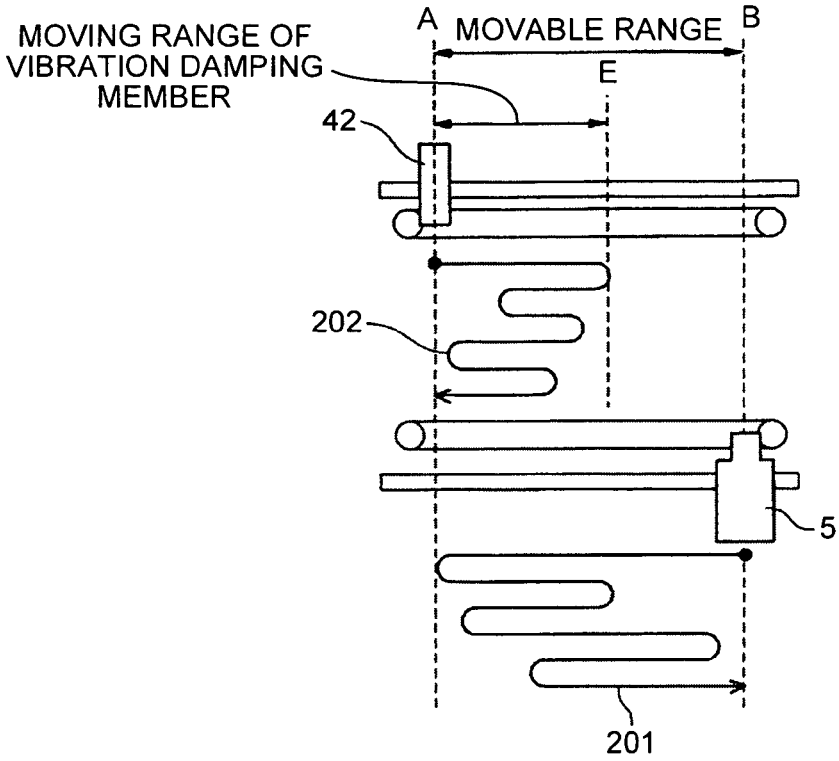
FIGS. 15A and 15B are explanatory diagrams for explaining how to change a moving range of the vibration damping member.

If a ratio of the acceleration of the vibration damping member 42 against the acceleration of the carriage 5 is decreased, the moving range of the vibration damping member 42 is narrowed down. At this time, as illustrated in FIG. 14A, assuming that the movable ranges of the carriage 5 and the vibration damping member 42 are the range between the main-scanning-direction positions A and B, and the positional relationship between the carriage 5 and the vibration damping member 42 is set so that the vibration damping member 42 is in the main-scanning-direction position A when the carriage 5 is in the main-scanning-direction position B, as illustrated in FIG. 15A, the moving range of the vibration damping member 42 is limited to a range between the main-scanning-direction position A and a main-scanning-direction position E. If they are used in this state, the center of gravity of the entire apparatus is lopsided to the left side.

Figure 15B:
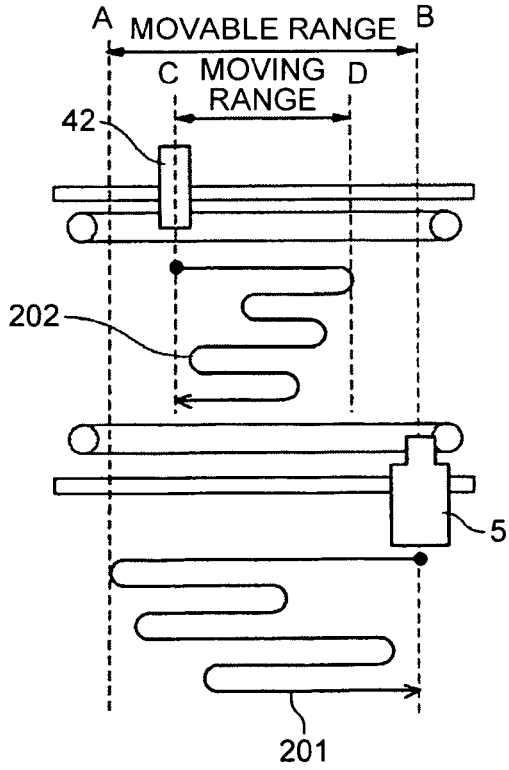

Consequently, after the home position of the vibration damping member 42 is reset so that the moving range of the vibration damping member 42 comes near the main-scanning-direction center as illustrated in FIG. 15B, the vibration damping member 42 is moved to a main-scanning-direction position C as illustrated in FIG. 15B, and the main-scanning-direction position C is set as a start position to move the vibration damping member 42, so that the center of gravity of the apparatus can come near the center.

At this time, if the vibration damping member 42 is just driven in synchronization with a change in the position of the carriage by the first pulse generating unit 118, the vibration damping member 42 stops moving if the carriage 5 stops moving, so the vibration damping member 42 cannot be moved by its own; therefore, it is controlled to drive the vibration-damping drive motor 41 by selecting a pulse that comes from the second pulse generating unit 120 which generates and outputs a pulse regardless of the movement of the carriage 5.

It is preferable to set the main-scanning-direction position C which is the move start position of the vibration damping member 42 so that the midpoint of the moving range of the vibration damping member 42 (a range between main-scanning-direction positions C and D) is not changed even if any of the ratios of the acceleration, the speed, and the moving range of the vibration damping member 42 to those of the carriage 5 is changed. If it is under the condition illustrated in FIG. 15B, it is set at the position that satisfies the condition of $AC=(AB-CD)/2$.

Incidentally, the apparatus may include a program causing a computer to execute a process of generating a pulse (a first pulse) to be given to the vibration-damping drive source in synchronization with the position of the carriage obtained by the carriage-position detecting unit described above and moving the vibration damping member by giving the first pulse to the vibration-damping drive source. Similarly, the apparatus may include a program causing a computer to execute various processes, such as: a process of setting an update amount of a count value for generating a first pulse causes the vibration-damping drive source to move by one step as a pulse/position multiple; a process of setting a pulse/position multiple in accordance with a result of detection by a remaining-amount detecting unit which detects a remaining amount of liquid in a liquid containing unit; a process of setting a pulse/position multiple in accordance with the print modes with different moving speeds of the cartridge; a process of generating a pulse (a second pulse) for driving the vibration-damping drive source in accordance with a moving-speed profile stored in the vibration-damping-member-speed-profile storage unit and controlling to drive the vibration-damping drive source by selecting the second pulse; a process of giving the second pulse when the home position of the vibration damping member in the moving direction is reset; and a process of giving the second pulse when the moving range of the vibration damping member is changed.

The programs may be stored in a storage medium, or may be provided by downloading from a network.

Furthermore, an image forming system may be configured by the image forming apparatus according to the present invention and an information processing apparatus, such as a personal computer, which provides print data to the image forming apparatus. Moreover, the image forming apparatus may include an image reading apparatus.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

a carriage that mounts thereon an image forming unit and reciprocates in a main scanning direction;

a carriage-position detecting unit that detects a position of the carriage in a moving direction;

a vibration damping unit that includes a vibration damping member driven to move by a vibration-damping drive source which may be controlled by an input of a pulse, and dampens vibration triggered by a movement of the carriage, the vibration-damping drive source being a different drive source from a drive source of the carriage;

a first pulse generating unit that generates the pulse to be given to the vibration-damping drive source in synchronization with the position of the carriage obtained by the carriage-position detecting unit; and a vibration-damping control unit that gives the pulse from the first pulse generating unit to the vibration-damping drive source thereby causing the vibration damping member to move, wherein:

the carriage position detecting unit includes a unit that counts the position of the carriage, the first pulse generating unit includes a unit that generates a pulse enabling the vibration-damping drive source to move by one step each time a count value of the carriage-position detecting unit reaches a set update amount, and the image forming apparatus further includes a pulse/position multiple setting unit that sets the update amount of the count value used for the first pulse generating unit to generate the pulse enabling the vibration-damping drive source to move by one step as a pulse/position multiple.

2. The image forming apparatus according to claim 1, wherein the image forming unit is a liquid discharge head for discharging a liquid droplet, the carriage mounts thereon the liquid discharge head and also a liquid containing unit that contains a liquid to be supplied to the liquid discharge head, the image forming apparatus further comprises a remaining-amount detecting unit that detects a remaining amount of liquid left in the liquid containing unit, and the pulse/position multiple setting unit sets the pulse/position multiple depending on a result of detection by the remaining-amount detecting unit.

3. The image forming apparatus according to claim 1, wherein the pulse/position multiple setting unit sets the pulse/position multiple depending on print modes with different moving speeds of the cartridge.

4. The image forming apparatus according to claim 1, further comprising:

a vibration-damping-member-speed-profile storage unit that stores therein a profile of moving speed of the vibration damping member; and a second pulse generating unit that generates a pulse for driving the vibration-damping drive source in accordance with the profile of moving speed stored in the vibration-damping-member-speed-profile storage unit, wherein the vibration-damping control unit selects any one of the pulse from the first pulse generating unit and the pulse from the second pulse generating unit, and controls to drive to the vibration-damping drive source with the selected pulse.

5. The image forming apparatus according to claim 4, wherein the vibration-damping control unit selects the pulse that comes from the second pulse generating unit when a home position of the vibration damping member in a moving direction is reset.

6. The image forming apparatus according to claim 4, wherein the vibration-damping control unit selects the pulse from the second pulse generating unit when a moving range of the vibration damping member is changed.

7. An image forming method that uses the image forming apparatus according to claim 1, the method comprising:

reciprocating the carriage in a main scanning direction;

detecting a position of the carriage in a moving direction;

dampening vibration triggered by the movement of the carriage;

generating the pulse to be given to the vibration-damping drive source in synchronization with the position of the carriage obtained by the carriage-position detecting unit; and giving the pulse from the first pulse generating unit to the vibration-damping drive source thereby causing the vibration damping member to move.

8. A computer program product that is used in the image forming apparatus according to claim 1, the computer program product comprises a computer usable medium having computer readable program codes embodied in the medium that when executed causes a computer to execute:

reciprocating the carriage in a main scanning direction;

detecting a position of the carriage in a moving direction;

dampening vibration triggered by the movement of the carriage;

generating the pulse to be given to the vibration-damping drive source in synchronization with the position of the carriage obtained by the carriage-position detecting unit; and giving the pulse from the first pulse generating unit to the vibration-damping drive source thereby causing the vibration damping member to move.

* * * * *